US006285839B1

(12) United States Patent
Tanaka et al.

(10) Patent No.: US 6,285,839 B1
(45) **Date of Patent: *Sep. 4, 2001**

(54) IMAGE FORMING APPARATUS HAVING FUNCTION FOR AUTOMATICALLY ADJUSTING IMAGE FORMING CONDITION

(75) Inventors: Masaki Tanaka, Toyohashi; Tetsuya Sakai, Aichi-Ken; Futoshi Hamada, Toyokawa; Toshifumi Watanabe, Amagasaki, all of (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/251,457

(22) Filed: Feb. 17, 1999

(30) Foreign Application Priority Data

Feb. 18, 1998 (JP) ..... 10-035729

(51) Int. Cl.[7] ..... G03G 15/00
(52) U.S. Cl. ..... 399/49
(58) Field of Search ..... 399/49, 50, 53, 399/55

(56) References Cited

U.S. PATENT DOCUMENTS 4,888,636 12/1989 Abe .
5,140,413 * 8/1992 Suzuki et al. ..... 358/80
5,311,261 * 5/1994 Nakagama et al. ..... 355/246
5,404,203 * 4/1995 Kinoshita et al. ..... 355/208
5,666,588 * 9/1997 Uchiyama et al. ..... 399/44
5,822,079 * 11/1999 Okuno et al. ..... 358/300
5,881,346 * 3/1999 Mori et al. ..... 399/301
5,920,748 * 11/1999 Kawai et al. ..... 399/59
5,926,669 * 7/1999 Sugimoto et al. ..... 399/66
5,966,222 * 10/1999 Hirata et al. ..... 358/520
5,966,560 * 10/1999 Kodama et al. ..... 399/66
5,978,615 * 11/1999 Tanaka et al. ..... 399/49
5,995,248 * 11/1999 Katori et al. ..... 358/501

* cited by examiner

*Primary Examiner*—Safet Metjahic
*Assistant Examiner*—E P LeRoux
(74) *Attorney, Agent, or Firm*—McDermott, Will & Emery

(57) ABSTRACT

A tandem-type image forming apparatus forms a color image by transferring images formed by a plurality of image forming units set along a transfer belt onto a recording sheet transported by the transfer belt. The tandem-type image forming apparatus includes a plurality of detecting units, each detecting a toner image formed by a corresponding image forming unit to obtain the amount of toner in the toner image, a standard pattern formation controlling unit for controlling one of the image forming units to form a standard pattern to be detected by the detecting units, a sensitivity obtaining unit for obtaining a value as an evaluation value that is outputted by each of the detecting units on detecting the standard pattern, and an detection output adjusting unit for adjusting a value outputted by the detecting unit in accordance with the evaluation value. An image forming condition is set for each of the image forming units in accordance with the adjusted value, and image formation is performed under the image forming conditions.

10 Claims, 17 Drawing Sheets

Fig. 2

TONER AMOUNT TABLE

| table number | detected amount of toner(mg/cm$^2$) | VG(V) | VO(V) | VB(V) |
|---|---|---|---|---|
| 0 | 0.625 | 500 | 480 | 280 |
| 1 | 0.510 | 540 | 520 | 320 |
| 2 | 0.445 | 570 | 545 | 345 |
| 3 | 0.400 | 600 | 570 | 370 |
| 4 | 0.380 | 630 | 590 | 390 |
| 5 | 0.340 | 670 | 630 | 420 |
| 6 | 0.305 | 710 | 660 | 440 |
| 7 | 0.275 | 750 | 700 | 480 |
| 8 | 0.250 | 800 | 750 | 540 |
| 9 | 0.210 | 900 | 820 | 620 |
| 10 | 0.180 | 1000 | 910 | 710 |

Fig. 7a

| value detected by AIDC sensor (V) | amount of toner on transfer belt (mg/cm$^2$) |
|---|---|
| 4.2 | 0.0 |
| 4.1 | 0.1 |
| 4.0 | 0.2 |
| 3.9 | 0.3 |
| : | : |
| : | : |
| 2.4 | 0.35 |
| 2.5 | 0.40 |
| 2.6 | 0.45 |
| : | : |
| : | : |
| 1.0 | 0.60 |
| 0.9 | 0.61 |
| 0.8 | 0.62 |
| 0.7 | 0.63 |
| 0.3 | : |
| 0.0 | 0.7 |

Fig. 7b

| value detected by AIDC sensor (V) | amount of toner on transfer belt (mg/cm$^2$) |
|---|---|
| 4.2 | 0.0 |
| 4.1 | 0.1 |
| 4.0 | 0.2 |
| 3.9 | 0.3 |
| : | : |
| : | : |
| 2.6 | 0.35 |
| 2.7 | 0.40 |
| 2.8 | 0.45 |
| : | : |
| : | : |
| 1.0 | 0.60 |
| 0.9 | 0.61 |
| 0.8 | 0.62 |
| 0.7 | 0.63 |
| 0.3 | : |
| 0.0 | 0.7 |

Fig. 7c

| value detected by AIDC sensor (V) | amount of toner on transfer belt (mg/cm$^2$) |
|---|---|
| 4.2 | 0.0 |
| 4.1 | 0.1 |
| 4.0 | 0.2 |
| 3.9 | 0.3 |
| : | : |
| : | : |
| 2.9 | 0.35 |
| 3.0 | 0.40 |
| 3.1 | 0.45 |
| : | : |
| : | : |
| 1.0 | 0.60 |
| 0.9 | 0.61 |
| 0.8 | 0.62 |
| 0.7 | 0.63 |
| 0.3 | : |
| 0.0 | 0.7 |

Fig. 7d

| value detected by AIDC sensor (V) | amount of toner on transfer belt (mg/cm$^2$) |
|---|---|
| 4.2 | 0.0 |
| 4.1 | 0.1 |
| 4.0 | 0.2 |
| 3.9 | 0.3 |
| : | : |
| : | : |
| 3.1 | 0.35 |
| 3.2 | 0.40 |
| 3.3 | 0.45 |
| : | : |
| : | : |
| 1.0 | 0.60 |
| 0.9 | 0.61 |
| 0.8 | 0.62 |
| 0.7 | 0.63 |
| 0.3 | : |
| 0.0 | 0.7 |

Fig. 7e

| value detected by AIDC sensor (V) | amount of toner on transfer belt (mg/cm$^2$) |
|---|---|
| 4.2 | 0.0 |
| 4.1 | 0.1 |
| 4.0 | 0.2 |
| 3.9 | 0.3 |
| : | : |
| : | : |
| 3.3 | 0.35 |
| 3.4 | 0.40 |
| 3.5 | 0.45 |
| : | : |
| : | : |
| 1.0 | 0.60 |
| 0.9 | 0.61 |
| 0.8 | 0.62 |
| 0.7 | 0.63 |
| 0.3 | : |
| 0.0 | 0.7 |

Fig. 13a

| value detected by AIDC sensor (V) | amount of toner on transfer belt (mg/cm$^2$) |
|---|---|
| 4.2 | 0.0 |
| 4.1 | 0.01 |
| 4.0 | 0.02 |
| 3.9 | 0.03 |
| ⋮ | ⋮ |
| 0.9 | 0.27 |
| 0.8 | 0.30 |
| 0.7 | 0.33 |
| ⋮ | ⋮ |
| 0.4 | 0.51 |
| 0.3 | 0.55 |
| 0.2 | 0.60 |
| 0.1 | 0.65 |
| 0.0 | 0.7 |

Fig. 13b

| value detected by AIDC sensor (V) | amount of toner on transfer belt (mg/cm$^2$) |
|---|---|
| 4.2 | 0.0 |
| 4.1 | 0.01 |
| 4.0 | 0.02 |
| 3.9 | 0.03 |
| ⋮ | ⋮ |
| 1.0 | 0.27 |
| 0.9 | 0.30 |
| 0.8 | 0.33 |
| ⋮ | ⋮ |
| 0.4 | 0.51 |
| 0.3 | 0.55 |
| 0.2 | 0.60 |
| 0.1 | 0.65 |
| 0.0 | 0.7 |

Fig. 13c

| value detected by AIDC sensor (V) | amount of toner on transfer belt (mg/cm$^2$) |
|---|---|
| 4.2 | 0.0 |
| 4.1 | 0.01 |
| 4.0 | 0.02 |
| 3.9 | 0.03 |
| ⋮ | ⋮ |
| 1.1 | 0.27 |
| 1.0 | 0.30 |
| 0.9 | 0.33 |
| ⋮ | ⋮ |
| 0.4 | 0.51 |
| 0.3 | 0.55 |
| 0.2 | 0.60 |
| 0.1 | 0.65 |
| 0.0 | 0.7 |

Fig. 13d

| value detected by AIDC sensor (V) | amount of toner on transfer belt (mg/cm$^2$) |
|---|---|
| 4.2 | 0.0 |
| 4.1 | 0.01 |
| 4.0 | 0.02 |
| 3.9 | 0.03 |
| ⋮ | ⋮ |
| 1.2 | 0.27 |
| 1.1 | 0.30 |
| 1.0 | 0.33 |
| ⋮ | ⋮ |
| 0.4 | 0.51 |
| 0.3 | 0.55 |
| 0.2 | 0.60 |
| 0.1 | 0.65 |
| 0.0 | 0.7 |

Fig. 13e

| value detected by AIDC sensor (V) | amount of toner on transfer belt (mg/cm$^2$) |
|---|---|
| 4.2 | 0.0 |
| 4.1 | 0.01 |
| 4.0 | 0.02 |
| 3.9 | 0.03 |
| ⋮ | ⋮ |
| 1.3 | 0.27 |
| 1.2 | 0.30 |
| 1.1 | 0.33 |
| ⋮ | ⋮ |
| 0.4 | 0.51 |
| 0.3 | 0.55 |
| 0.2 | 0.60 |
| 0.1 | 0.65 |
| 0.0 | 0.7 |

IMAGE FORMING APPARATUS HAVING FUNCTION FOR AUTOMATICALLY ADJUSTING IMAGE FORMING CONDITION

This application is based on an application No. 10035729 filed in Japan, the content of which is hereby incorporated by reference.

BACKGROUND OF THE INVENTION (1) Field of the Invention

The present invention relates to a so-called "tandem-type" image forming apparatus, and particularly relates to a technique for adjusting variations in sensitivity among sensors when the sensors respectively detect toner images formed by image forming units to control an image forming condition.

(2) Related Art

For conventional color copiers, a method using a transfer drum or intermediate transfer component has been commonly employed. A color copier using this method is provided with a single image forming unit, and a photosensitive drum in the image forming unit is rotated for each color. Toner images formed corresponding to colors cyan, magenta, yellow, and black are superimposed to form a color image. Hereinafter, these toner colors are referred to as "C", "M", "TY", and "K".

As stated above, this conventional color copier is provided with a single photosensitive drum. Thus, for the automatic image density control (referred to as the "AIDC" hereinafter) and the correction, the amount of toner attracted to the photosensitive drum is detected for each color using a single photoelectric sensor (referred to as the "AIDC sensor" hereinafter).

The following is a brief description of an example of the AIDC performed using the AIDC sensor.

For the AIDC, the AIDC sensor detects the density of a standard patch (referred to as the "AIDC pattern" hereinafter). In accordance with the detection value, a grid voltage VG of a sensitizing charger and a developing bias voltage VB of a developing unit are controlled by referring to a table that is stored in a memory beforehand. Consequently, the image density is appropriately maintained.

FIG. 1 is a schematic diagram showing an arrangement of a photosensitive drum 301, a sensitizing charger 302, and a developing unit 303 of the image forming unit provided in the conventional color copier. As shown in this diagram, the sensitizing charger 302 is set facing the photosensitive drum 301, with the discharge voltage being referred to as VC. A grid 3021 of the sensitizing charger 302 is applied a negative grid voltage VG by a VG generating unit 304. The grid voltage VG is considered to be almost equivalent to a surface potential VO of the photosensitive drum 1C. This is to say, the surface potential VO of the photosensitive drum 301 can be controlled by adjusting the grid voltage VG.

A developing roller 3031 of the developing unit 303 is applied a negative developing bias voltage VB by a VB generating unit 305, with the developing bias voltage VB satisfying an inequality $|VB|<|VO|$. Accordingly, the surface potential of the developing roller 3031 becomes VB.

When the laser exposure is performed on the photosensitive drum 301 in this state, the surface potential of the exposed part on the photosensitive drum 301 increases and becomes a voltage VI. When the voltage VI becomes higher than the developing bias voltage VB, negatively charged toner carried to the surface of the developing sleeve of the developing roller 3031 is attracted to the exposed part on the photosensitive drum 301. The higher a developing voltage ΔV is, the more amount of toner is attracted to the exposed part. Here, the developing voltage ΔV is calculated according to the following equation.

$$\Delta V=|VB-VI|$$

As such, the developing voltage ΔV changes as the surface potential VO and the bias voltage VB are changed.

Consequently, the amount of toner attracted to the photosensitive drum 301 can be controlled by changing the surface potential VO and the bias voltage VB.

With this being the situation, a AIDC sensor 306 detects the amount of toner in the AIDC pattern that is formed on the photosensitive drum 301 under a predetermined level of exposure. In accordance with the detection result, the VG and the VB are adjusted, so that the density of the AIDC pattern can be maintained constant.

More specifically, the values of the VG and VB are set from the detection value obtained by the AIDC sensor 306 in accordance with a table shown in FIG. 2 which is experimentally obtained.

In recent years, tandem-type color copier have been increasingly used. In a tandem-type color copier, toner images respectively formed on photosensitive drums set along a transfer belt are transferred onto a recording sheet transported on the transfer belt or onto the transfer belt to form a color image.

In this tandem-type color copier, an image forming unit is provided for each color. Thus, it is preferable to provide an AIDC sensor for each image forming unit to detect the amount of attracted toner. By doing so, the AIDC can be separately performed for each color.

In this case, however, if the sensitivity of the AIDC sensors varies, a color balance of the formed image is inappropriate.

When the amount of attracted toner is detected by the single AIDC sensor as explained about the conventional color copier employing the method using the transfer drum, it is a minor problem if a detection value obtained by the AIDC sensor has an error. In this case, the detected density for each color is darker or lighter than an actual color at the same level based on the error. Therefore, each density of toner images is adjusted in the same direction in accordance with the error, so that the color balance can be maintained.

Meanwhile, when the AIDC sensor for detecting the amount of toner is provided for each of the photosensitive drums in the tandem-type color copier, the sensitivity of the AIDC sensors may vary. In this case, even when the AIDC sensors respectively detects AIDC patterns formed in the same density, the AIDC sensors may output different detection values.

As one example, when the sensitivity of the AIDC sensors for Y and K is low, each density of the yellow and black AIDC patterns is detected lower than the actual density. In this case, these density of yellow and black are corrected in a way that these colors become darker than they should. FIG. 3 shows gradation characteristics of C, M, Y, and K obtained as a result of the incorrect density adjustment. As shown in FIG. 3, yellow and black colors are enhanced. The color of the formed image is out of balance due to the enhanced these colors.

In particular, when a color to be reproduced belongs to a gray area, it is important to reproduce the color in the correct color balance. Variations in the gradation characteristics of toner colors lead to deterioration in the color reproduction.

SUMMARY OF THE INVENTION

The object of the present invention is to provide a tandem-type image forming apparatus, in which toner images are formed by a plurality of image forming units and the amounts of toner in the toner images are detected by respective detecting units to control an image forming condition, that corrects a reproduced density for each color by adjusting variations in sensitivity of the detecting units so that an image with high color reproduction is obtained.

The object of the present invention can be achieved by an image forming apparatus forming an image by transferring images respectively formed by a plurality of image forming units onto one of a recording material transported by a transfer belt and the transfer belt, being made up of: a plurality of detecting units, each of which is provided in a different image forming unit and detects an amount of toner in a toner image formed by a corresponding image forming unit; a first value obtaining unit for obtaining a value outputted by each of the plurality of detecting units on detecting a same standard pattern as first values; a second value obtaining unit for obtaining a value outputted by each of the detecting units on detecting the toner image formed by the corresponding image forming unit as second values; an adjusting unit for adjusting each second value in accordance with the first value outputted by a same detecting unit as the second value; an image forming condition setting unit for setting an image forming condition for each of the image forming units in accordance with the adjusted second value; and a controlling unit for controlling each of the image forming units to perform an image formation under the set image forming condition.

The object of the present invention can be also achieved by an image forming condition setting method for an image forming apparatus which forms an image by transferring images formed by a plurality of image forming units onto one of a recording material transported by a transfer belt and the transfer belt, wherein the image forming condition setting method is used for setting an image forming condition for each of the plurality of image forming units in accordance with a value outputted by a detecting unit of the image forming unit on detecting a toner image formed by the image forming unit, the image forming condition setting method including: a first value obtaining step for obtaining a value outputted by each of a plurality of detecting units on detecting a same standard pattern as first values; a second value obtaining step for obtaining a value outputted by each of the detecting units on detecting the toner image formed by the corresponding image forming unit as second values; an adjusting step for adjusting each second value in accordance with the first value outputted by a same detecting unit as the second value; and an image forming condition setting step for setting an image forming condition for each of the image forming units in accordance with the adjusted second value.

Note that each output value of the detecting units includes a detection value directly obtained by a sensor provided in each of the detecting units and also includes a value outputted after the detection value is converted using a table, such as a conversion table.

Each of the first output values from the detecting units is obtained by detecting the common standard pattern, and so reflects the variations in sensitivity of the detecting units. As such, each of the second output values obtained by detecting the toner image formed by the corresponding image forming unit is adjusted in accordance with the first output value. By doing so, the variations in sensitivity of the detecting units are appropriately adjusted and a correct image forming condition is set. Consequently, the adjustment is reliably executed for each color, thereby maintaining the color balance of the reproduced image excellent.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawing:

FIG. 2 shows a table used for obtaining a grid voltage and a bias voltage from the amount of toner;

FIGS. 7*a* to 7*e* show tables in which each output voltage is associated with the amount of toner according to the sensitivity of the AIDC sensor;

FIGS. 13*a* to 13*e* show tables in which each voltage outputted from the AIDC sensor is associated with the amount of toner according to the sensitivity of the AIDC sensor, in a case where toner containing carbon is used as black toner;

DESCRIPTION OF PREFERRED EMBODIMENTS

The following is a description of embodiments of the present invention, with reference to the accompanying drawings. In the embodiments, a tandem-type digital color copier (simply referred to as the "copier" hereinafter) is used as an example.

First Embodiment (1) Construction of Copier

Figure 1:
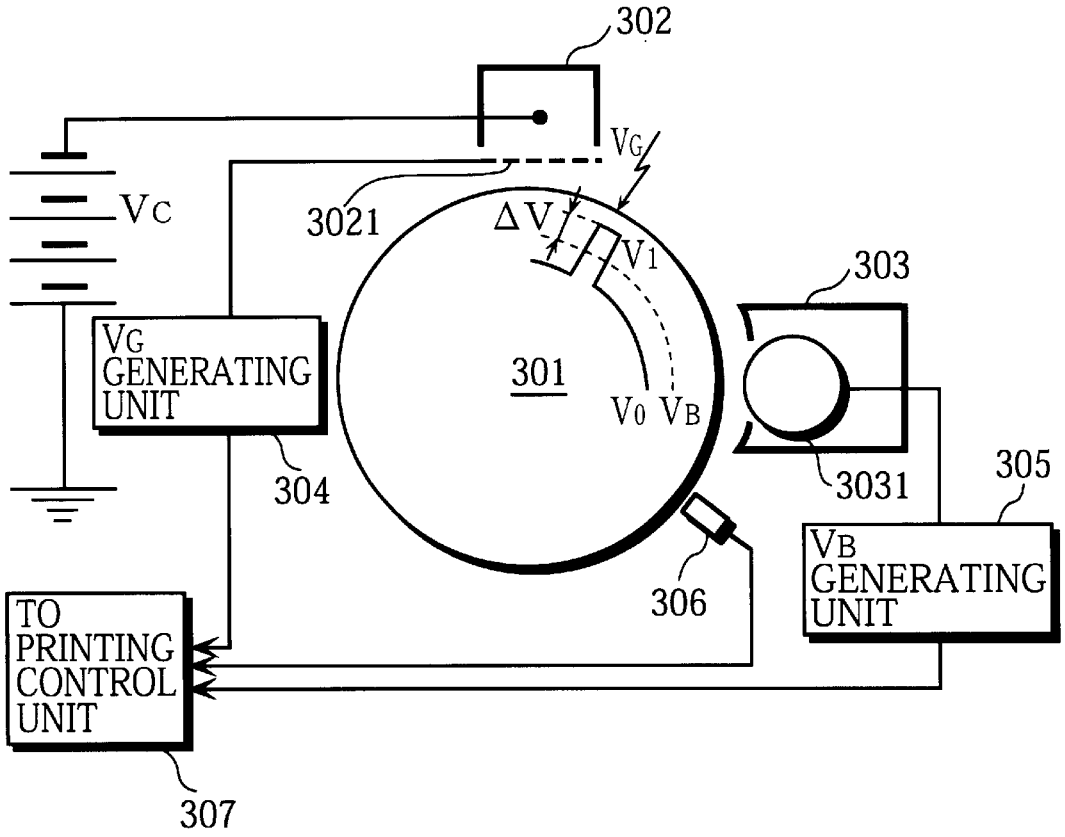
FIG. 1 is a schematic diagram showing a construction of an image forming unit.
Figure 3:
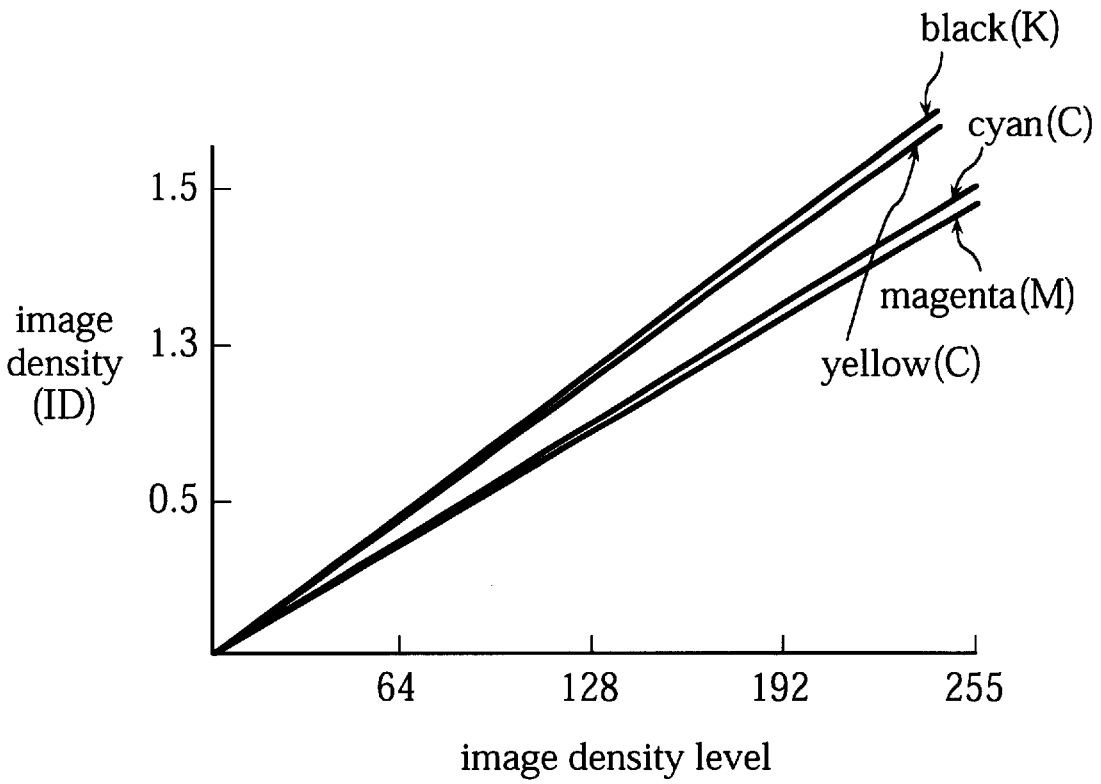
FIG. 3 shows gradation characteristics in a case where the color of a reproduced image is out of balance.
Figure 4:
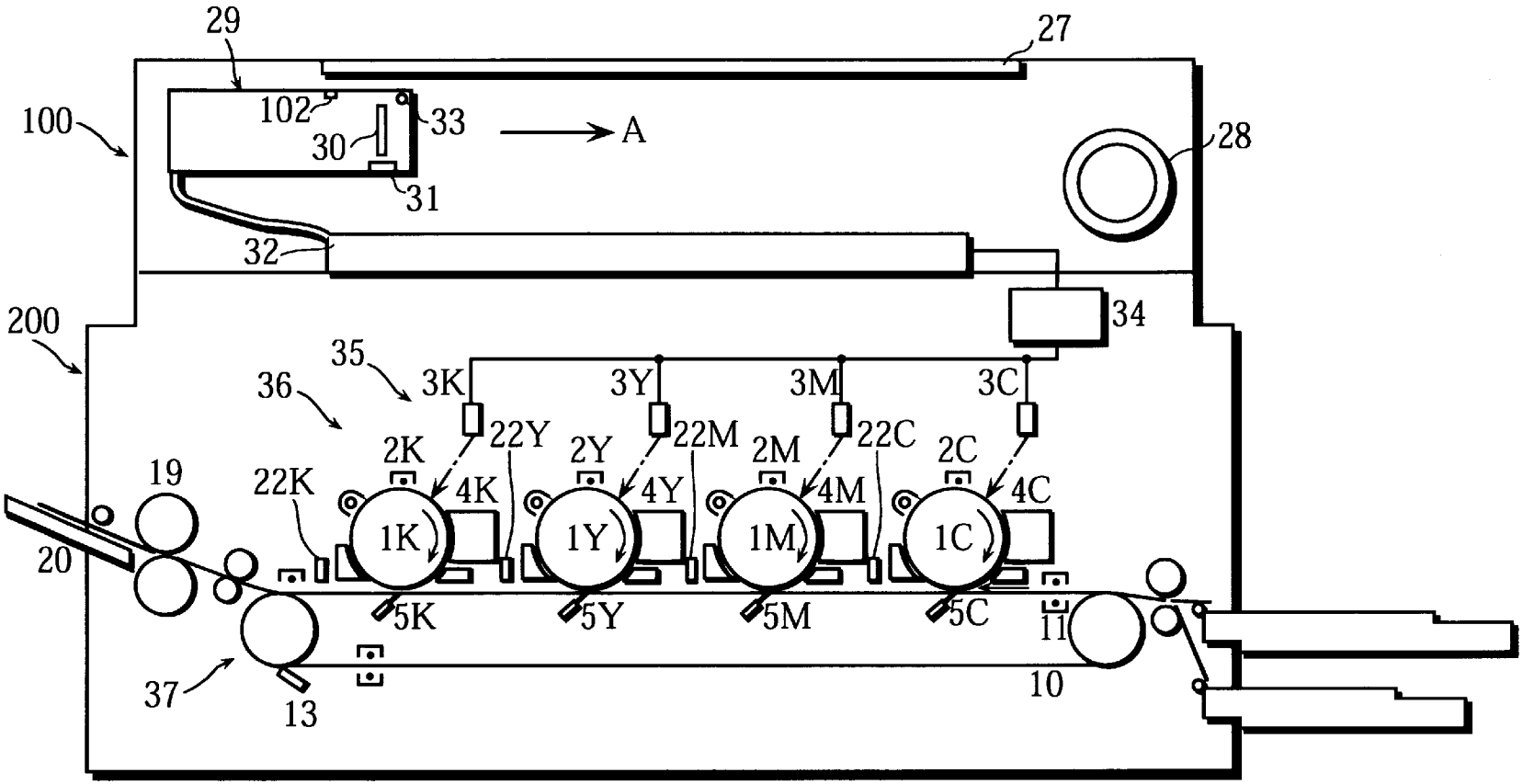
FIG. 4 is a schematic cross-sectional view showing a digital color copier of the first embodiment.

FIG. 4 is a schematic cross-sectional view showing the copier of the first embodiment. This copier is a tandem-type copier in which toner images formed by a plurality of image forming units set along a transport belt are superimposed to form a color image.

The present invention is explained using a digital copier as an example. However, the present invention is not limited to this and can be applied to various tandem-type image forming apparatuses, such as an analog copier, a printer, and a facsimile.

The copier shown in FIG. 4 is mainly composed of an image reading unit 100 for reading a document image and a printing unit 200 for reproducing the document image read by the image reading unit 100.

The image reading unit 100 is provided with a scanner 29 and a signal processing unit 32. The scanner 29 scans a document placed on a platen glass 27 and reads the document image as multivalued electric signals for each of colors red (R), green (G), and blue (B). The signal processing unit 32 performs processes, such as a gradation data correction, on the electric signals obtained by the scanner 29. The scanner 29 is driven by a motor 28 to scan the document and moves laterally as indicated by the arrow A in FIG. 4. Light from an exposure lamp 33 of the scanner 29 is reflected off the document placed on the platen glass 27, and is converged by a rod lens array 30. The converged light is converted into multivalued electric signals for three colors R, G, and B by a contact-type CCD color image sensor 31 (referred to as the "CCD sensor 31" hereinafter).

The signal processing unit 32 converts each multivalued electric signal into 8-bit gradation data for C, M, Y, or K and also performs the color correction processing, etc. This 8-bit gradation data corresponds to the density of a reproduced color.

The printing unit 200 is composed of a printing processing unit 34, a laser optical system 35, an image forming system 36, and a transporting system 37. With this construction, the printing processing unit 34 generates a laser diode driving signal corresponding gradation data for each color in accordance with the signal outputted from the signal processing unit 32, and then has laser diodes of corresponding printer heads 3C to 3K of the laser optical system 35 emit laser beams in accordance with corresponding driving signals. These Laser beams respectively expose photosensitive drums 1C to 1K.

The photosensitive drums 1C to 1K are uniformly charged by chargers 2C to 2K. By means of the exposure, electrostatic latent images are respectively formed on the surfaces of the photosensitive drums 1C to 1K. Developing units 4C to 4K respectively develop the electrostatic latent images formed on the corresponding photosensitive drums 1C to 1K using toner of corresponding colors C, M, Y, and K. The developed toner images are sequentially transferred onto the recording sheet transported by a transport belt 10 by means of actions of the positive electric fields applied by transfer brushes 5C to 5K. The recording sheet is separated from the transport belt 10 after the image transfer, and a fixing unit 19 then fixes toner particles forming the image on the recording sheet. After this, the recording sheet is discharged onto a discharge tray 20.

AIDC sensors 22C to 22K are respectively provided for the photosensitive drums lC to 1K for detecting the amount of the corresponding color toner after the image transfer. The AIDC sensors 22C to 22K are respectively set above the upper surface of the transport belt 10 and set after the photosensitive drums 1C to 1K in the transporting direction of the recording sheet. Reflection type sensors are used as the AIDC sensors 22C to 22K. Each of the AIDC sensors 22C to 22K detects the amount of toner in an AIDC pattern and a standard pattern (described later) which are separately formed on the transfer belt 10 by the corresponding photosensitive drum lC to 1K. In doing so, each of the AIDC sensors 22C to 22K detects the amount of light reflected off the AIDC pattern or the standard pattern as a voltage value, the light being emitted from an LED of the corresponding AIDC sensor 22C to 22K. It should be obvious that a transmission type sensor can be used as the AIDC sensor in a case where the transfer belt 10 is made of transparent material. In this case, an LED and a photo sensor of the transmission type sensor are respectively set above the upper surface and under the lower surface of the transfer belt 10.

The amount of toner attracted to the transfer belt 10 can be obtained for each color from the voltage value outputted from the corresponding AIDC sensor 22C to 22K using a table in which the voltage value is associated with the amount of toner attracted to the transfer belt 10. This table is described in detail later in this specification. In accordance with the detected amount of toner, the grid voltage VG and the developing bias voltage VB are set for each of the image forming units.

The AIDC sensors 22C to 22K are respectively set at locations that are different to one another in the main scanning direction, so that each of the AIDC sensors does not detect any other AIDC pattern or standard pattern. To obtain the essentially same amount of light reflected off patterns formed of the same amount of toner, the AIDC sensors 22C to 22K respectively use lights in the infrared region as detection lights. A light in the infrared region has a total reflection characteristic for each of C, M, Y, and K toner. In the present embodiment, a mixture of C, M, and Y toner (referred to as the "mixed toner" hereinafter) is used as black toner, so that the total reflection characteristic can be obtained. However, there may be a case where a red light emitted from an LED is used without passing through a filter or where black toner containing carbon (referred to as the "carbon toner" and described later) is used. In this case, the present invention can be applied without problems by adjusting the detected voltage value between the four colors or using a table provided for each color.

(2) Control System

Figure 5:
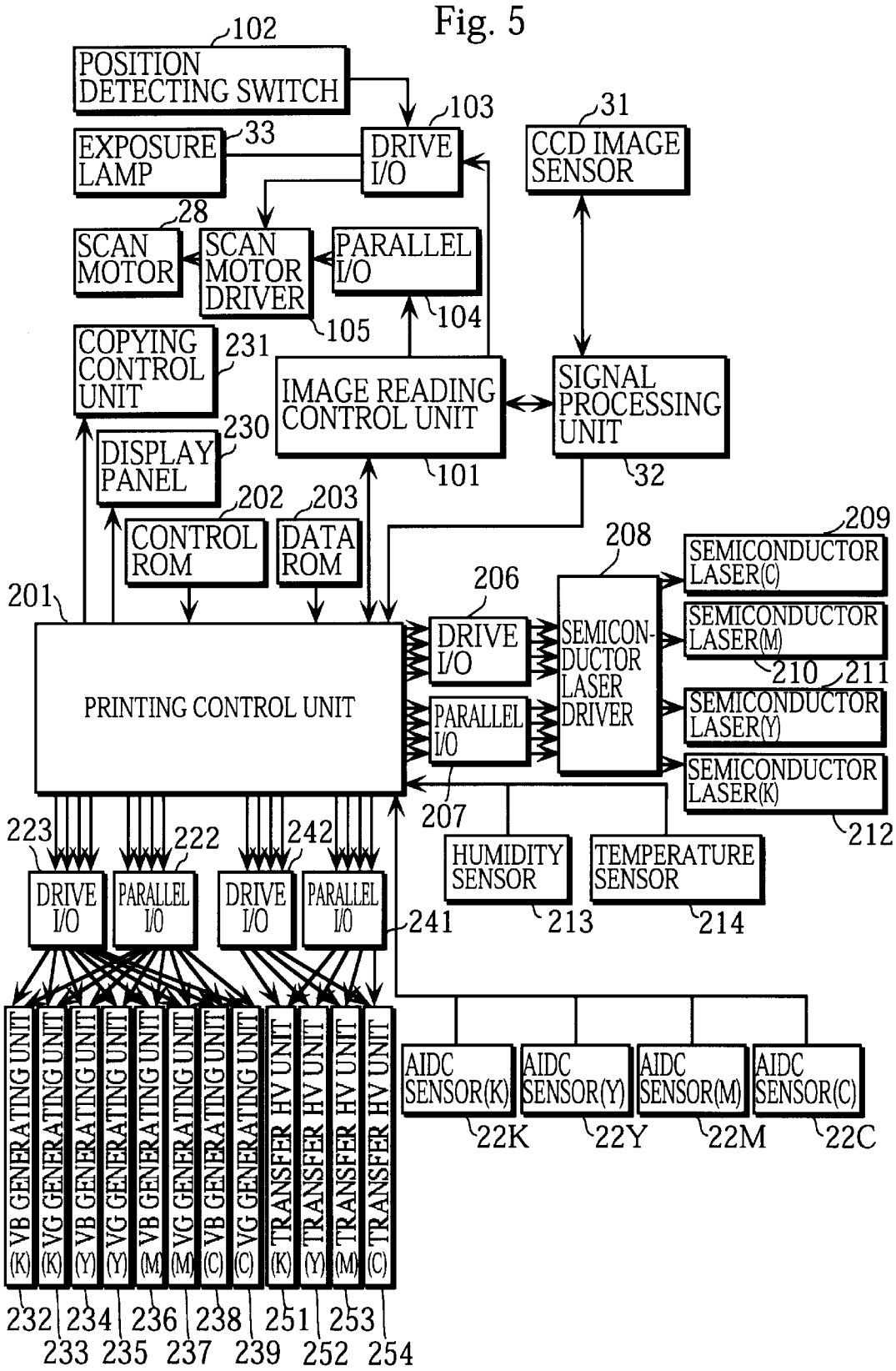
FIG. 5 is a block diagram showing a construction of a control system provided in the digital color copier of the first embodiment.

The following is a description of a control system provided in the copier. FIG. 5 is a block diagram showing the construction of the control system. Central components of the control system are an image reading control unit 101 for controlling the image reading unit 100, a signal processing unit 32, and a printing control unit 201 for controlling the printing unit 200.

The image reading control unit 101 controls an exposure lamp 33 and a scan motor driver 105 which drives a scan motor 28, via a drive I/O 103 and a parallel I/O 104 by referring to a position signal outputted from a position detecting switch 102. Here, the position signal from the position detecting switch 102 indicates a position of a document on a platen glass 27. In accordance with this control operation, image signals are obtained by the CCD image sensor 31. The image signals are inputted to the signal processing unit 32, and then are subjected to data processing, such as gradation data conversion and shading correction.

The printing control unit 201 controls a semiconductor laser driver 208 via a drive I/O 206 and a parallel I/O 207 in accordance with the image signals processed by the signal processing unit 32 to drive semiconductor lasers 209 to 212 to expose the photosensitive drums 1C to 1K. The printing control unit 201 also controls operations of the printing unit 200 via the copying control unit 231, according to programs stored in a control ROM 202 and using various data stored in a data ROM 203.

Voltages applied to the transfer brushes 5C to 5K for image formation are generated by transfer HV units 251 to 254 which are controlled by the printing control unit 201 via a drive I/O 242 and a parallel I/O 241.

Furthermore, the printing control unit 201 receives detection signals from the AIDC sensors 22C to 22K which respectively detect the amounts of toner in the toner images transferred onto the transfer belt 10, a humidity sensor 213, and a temperature sensor 214. In accordance with these detection values, the printing control unit 201 performs various controls, such as AIDC (Automatic Image Density Control), transfer output control, exposure control, and AIDC sensor sensitivity adjustment control (referred to as "sensitivity adjustment control" hereinafter).

For the AIDC, via a parallel I/O 222 and a drive I/O 223, the printing control unit 201 controls VG generating units 233, 235, 237, and 239 to generate the grid voltages VGs of the chargers 2C to 2K, and controls VB generating units 232, 234, 236, and 238 to generate the developing bias voltages VBs of the developing units 4C to 4K in accordance with the detection values given by the AIDC sensors 22C to 22K. In doing so, the printing control unit 201 uses a table which is stored in the data ROM 203 beforehand.

The image density is adjusted for each color by controlling the grid voltage VG and developing bias voltage VB. This AIDC for each image forming unit is the same as the conventional AIDC stated above.

The copying control unit 231 controls an operation performed by a mechanism of the printing unit 200, the transporting system 37 in particular. A display panel 230 displays contents of a copy mode set by the user and various messages.

(2-1) Sensitivity Adjustment Control

Figure 6:
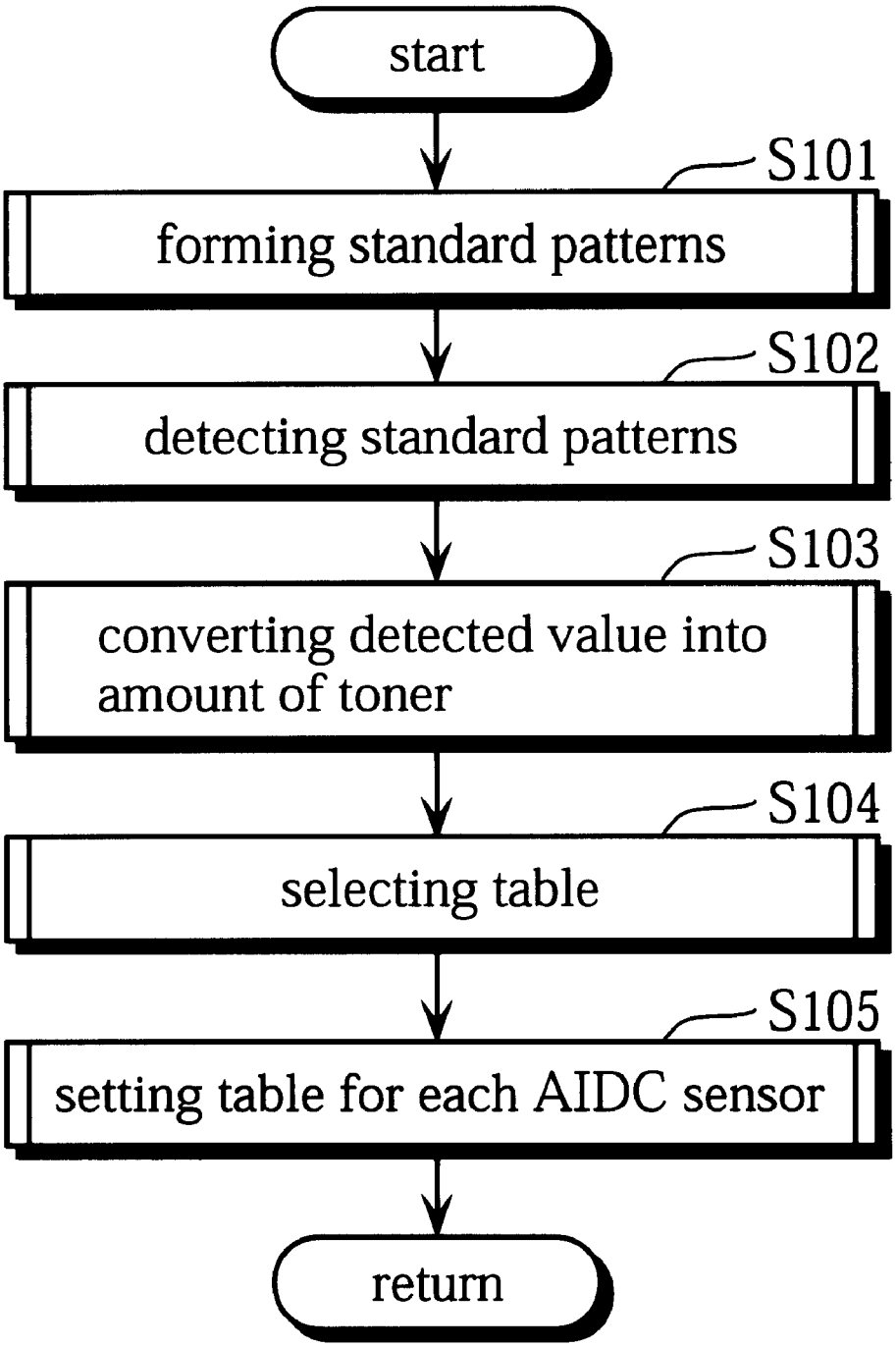
FIG. 6 is a flowchart of an operation performed for AIDC sensor sensitivity adjustment control.

The following is a description of the sensitivity adjustment control performed to reduce variations in sensitivity among the AIDC sensors. This sensitivity adjustment control is periodically performed, and a timing of the sensitivity adjustment control can be arbitrarily set. This can be said to the second embodiment described later in this specification. FIG. 6 is a flowchart of the control operation performed for the sensitivity adjustment control. Each sensitivity of the AIDC sensors 22C to 22K is adjusted using one of the tables in which a voltage outputted from the AIDC sensor is associated with the amount of toner, the tables being stored in the data ROM 203. Here, the appropriate table is selected from the stored tables for each of the AIDC sensors 22C to 22K in accordance with the sensitivity of the AIDC sensor 22C to 22K. FIGS. 7*a* to 7*e* are table examples and selectively used in accordance with the sensitivity of the AIDC sensors 22C to 22K. Each of the tables in FIGS. 7*a* to 7*e* shows a relation between a detection value obtained by the AIDC sensor 22C to 22K and the amount of toner attracted to the transfer belt 10. The tables of FIGS. 7*a* to 7*e* are shown in descending order of the sensitivity of the AIDC sensors 22C to 22K.

Figure 8:
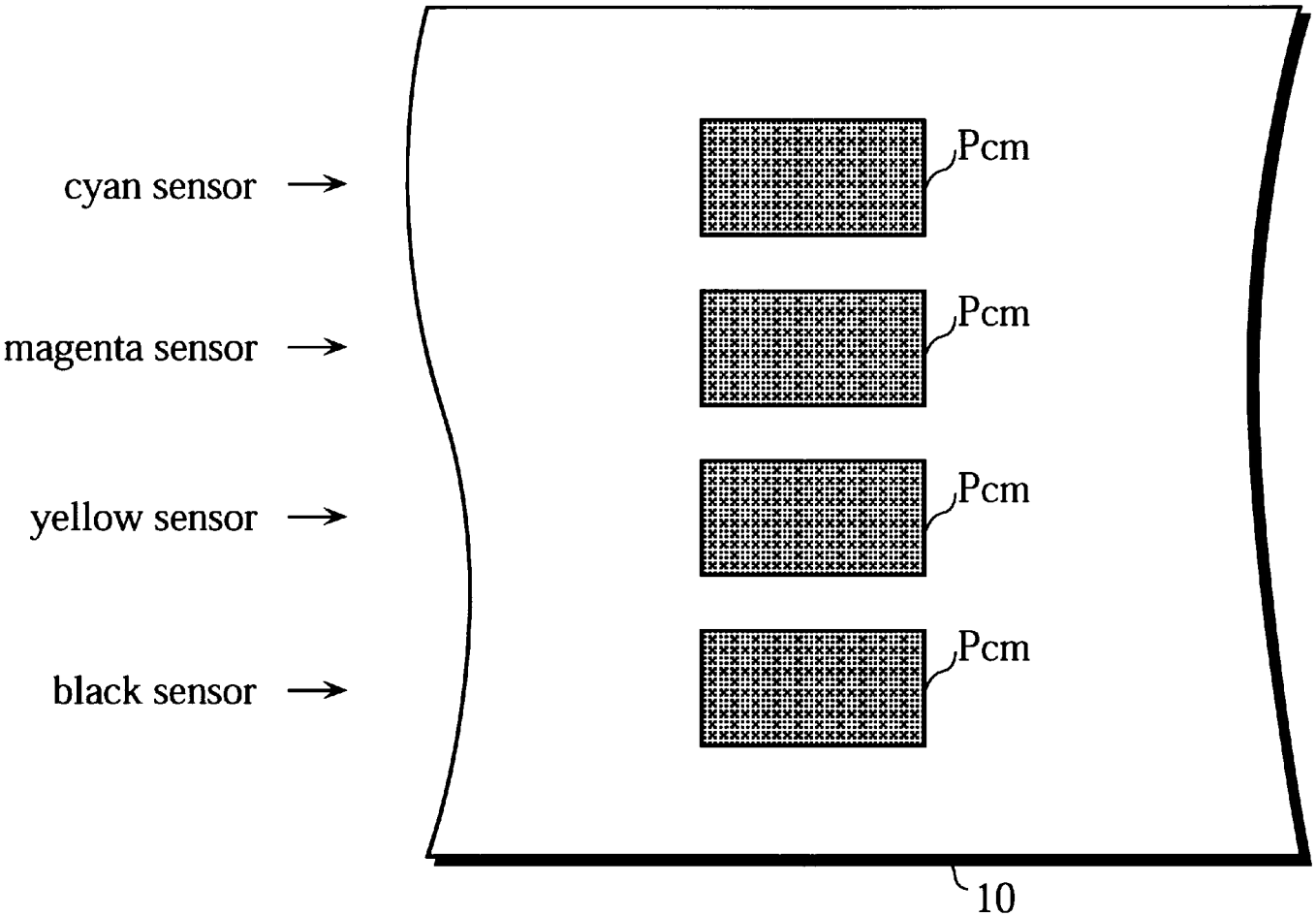
FIG. 8 shows an example of standard patterns used for the AIDC sensor sensitivity adjustment control of the first embodiment.

The printing control unit 201 first controls the image forming unit including the photosensitive drum 1C to form standard patterns Pcm as shown in FIG. 8 (step S101). The standard patterns Pcm are formed under predetermined image forming conditions including the grid voltage VG and the developing bias voltage VB. The image forming conditions are set so that each amount of toner attracted to the transfer belt 10 to form the corresponding standard pattern Pcm is 0.4(mg/cm$^2$), which is a medium amount. The standard patterns Pcm are respectively formed at locations corresponding to the locations of the AIDC sensors 22C to 22K in the main scanning direction.

The transfer belt 10 moves, and each of the AIDC sensors 22C to 22K detects the corresponding standard pattern Pcm when the standard pattern Pcm passes directly under the AIDC sensor 22C to 22K. After the detection, each of the AIDC sensors 22C to 22K outputs the detection value of the standard pattern Pcm as the voltage value to the printing control unit 201 which then stores the voltage value in its internal memory (step S102).

The printing control unit 201 converts the voltage values outputted from the AIDC sensors 22C to 22K into the amounts of toner, using the table of FIG. 7*c* that corresponds to the medium sensitivity (step S103). These converted values are used as evaluation values for evaluating the sensitivity of the AIDC sensors 22C to 22K. The printing control unit 201 compares the amounts of toner to 0.4(mg/cm$^2$) that is the standard amount of toner. In accordance with the comparison results, the printing control unit 201 selects one of the tables shown in FIGS. 7*a* to 7*e* for each of the AIDC sensors (step S104).

The following is a description how one of the table is selected for each of the AIDC sensors. When the amount of toner obtained by the AIDC sensor is equal to or more than 0.45 (mg/cm$^2$), the table of FIG. 7*a* corresponding to the AIDC sensor having the highest sensitivity is selected. When the amount of toner is equal to or more than 0.4(mg/cm$^2$) and less than 0.45 (mg/cm$^2$), the table of FIG. 7*b* corresponding to the AIDC sensor having the rather high sensitivity is selected. When the amount of toner is equal to or more than 0.35(mg/cm$^2$) and less than 0.4(mg/cm$^2$), the table of FIG. 7*c* corresponding to the AIDC sensor having the medium sensitivity is selected. When the amount of toner is equal to or more than 0.3(mg/cm$^2$) and less than 0.35(mg/cm$^2$), the table of FIG. 7*d* corresponding to the AIDC sensor having the rather low sensitivity is selected. When the amount of toner is less than 0.3(mg/cm$^2$), the table of FIG. 7*e* corresponding to the AIDC sensor having the lowest sensitivity is selected. After selecting the table for each of the AIDC sensors, the selected table is set as the table used for obtaining the amount of toner in the AIDC pattern formed from a corresponding color toner when the AIDC is performed (step S105).

By means of the stated operation, the appropriate table is selected in accordance with the sensitivity of the corresponding AIDC sensor 22C to 22K. Even when the sensitivity of the AIDC sensors 22C to 22K varies, reliable values can be obtained as the amount of toner in the AIDC pattern. Consequently, the color balance of the image to be formed is properly maintained.

(2-1-2) Adjustment by Correction Coefficient

As described above, for the sensitivity adjustment control, a table is selected from a plurality of tables in accordance with the sensitivity of the corresponding AIDC sensor 22C to 22K. However, the sensitivity adjustment control may be performed as follows. Using one table as a standard table, a reliable value as the amount of toner may be obtained by multiplying the amount of toner obtained using the standard table by a correction coefficient or by adding the correction coefficient to the amount of toner.

As one example, suppose that the correction coefficient is C and that the sensitivity adjustment control is performed through multiplication using the correction coefficient C. When the amount of toner is 0(mg/cm$^2$) or 0.7(mg/cm$^2$), a value "1" is assigned to the correction coefficient C. When the amount of toner is 0.35(mg/cm$^2$), which is medium amount, the greatest or smallest value is assigned to the correction coefficient C. Thus, the following quadratic expression is formulated, with a variable M set as the amount of toner.

$$C=k\cdot M\cdot(M-0.7)+1 \quad (1)$$

Here, image forming conditions including the developing bias voltage VB are set so that each amount of toner attracted to the transfer belt 10 to form the standard pattern is 0.35(mg/cm$^2$). The AIDC sensors 22C to 22K respectively detect the standard patterns formed under the image forming conditions. Using the table shown in FIG. 7*c* as the standard table, the amount of toner attracted to the transfer belt 10 before the sensitivity adjustment control is obtained from the detection value given by the corresponding AIDC sensor 22C to 22K, using the table of FIG. 7*c*. The converted value is multiplied by the correction coefficient C. As one example, suppose that the amount of toner detected by the corresponding AIDC sensor 22C to 22K is $T\times10^{-2}$(mg/cm$^2$). In this case, the correction coefficient C is 35/T. Thus, a coefficient k is obtained by calculating the following equation by substituting the value 0.35 of M(mg/cm$^2$) and the value 35/T of C into the quadratic expression ①.

$$k=1/(0.35)^2-1/0.35T$$

Then, the correction coefficient C is obtained by calculating the quadratic expression.

$$C=(1/(0.35)^2-1/0.35T)\cdot M\cdot(M-0.7)+1$$

Meanwhile, when the corrected amount of toner is obtained by adding the correction efficient to the amount of toner converted using the standard table, a quadratic expression is formulated as in the case of the multiplication. In this case, an initial condition may be set so that a value "0" is assigned to the correction coefficient C when the amount of toner is 0(mg/cm$^2$) or 0.7(mg/cm$^2$). Although the correction coefficient C is obtained by the quadratic expression, the expression used here is not limited to this.

In addition, for each sensitivity of the AIDC sensors 22C to 22K, a table may be previously stored that shows a relation between the correction coefficient C and the voltage value or the amount of toner converted using the standard table. By means of this table, the corrected amount of toner may be obtained by multiplying the converted amount of toner by a correction coefficient or by adding the correction efficient to the converted amount of toner.

(2-1-3) Adjustment by Transform Expression

As a method for adjusting the sensitivity of the AIDC sensor, the amount of toner may be obtained from the detection value given by the AIDC sensor using a transform function. The following is a detailed explanation of this method.

Figure 9:
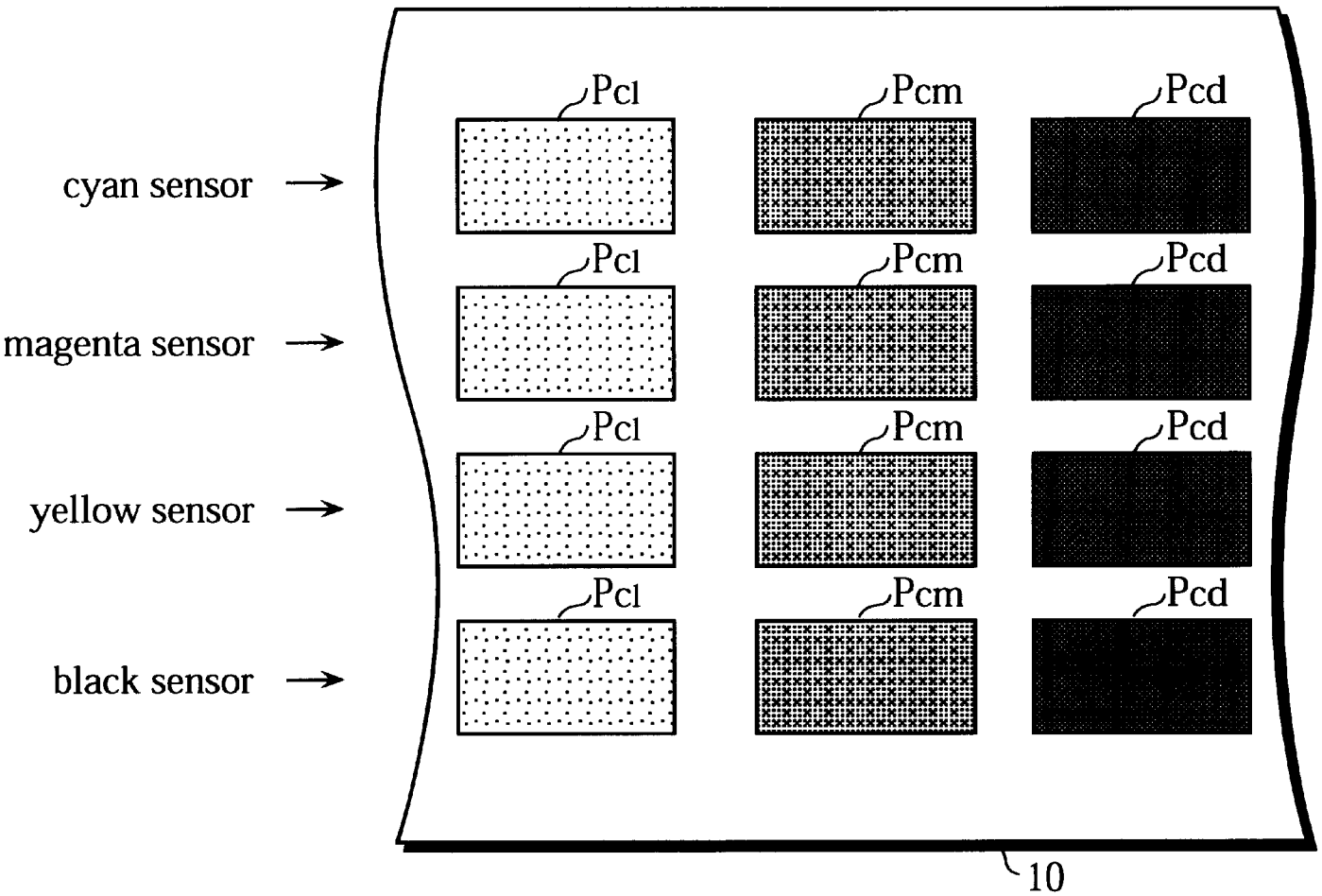
FIG. 9 shows an example of standard patterns used for the AIDC sensor sensitivity adjustment control of the first embodiment.

The printing control unit 201 first controls the image forming unit including the photosensitive drum 1C to form three different types of standard patterns Pcl, Pcm, and Pcd on the transfer belt 10 for each of the AIDC sensors to detect, as shown in FIG. 9. The standard patterns Pcl, Pcm, and Pcd vary in the amount of toner used. The standard pattern Pcl is formed of a small amount of toner (0.2mg/cm$^2$). The standard pattern Pcm is formed of a medium amount of toner (0.4mg/cm$^2$). The standard pattern Pcd is formed of a large amount of toner (0.6mg/cm$^2$). For forming these three types of standard patterns, image forming conditions are differently set for each standard pattern. Note that the standard patterns Pcl, Pcm, and Pcd are formed at locations corresponding to the locations of the AIDC sensor 22C to 22K in the main scanning direction.

Figure 10:
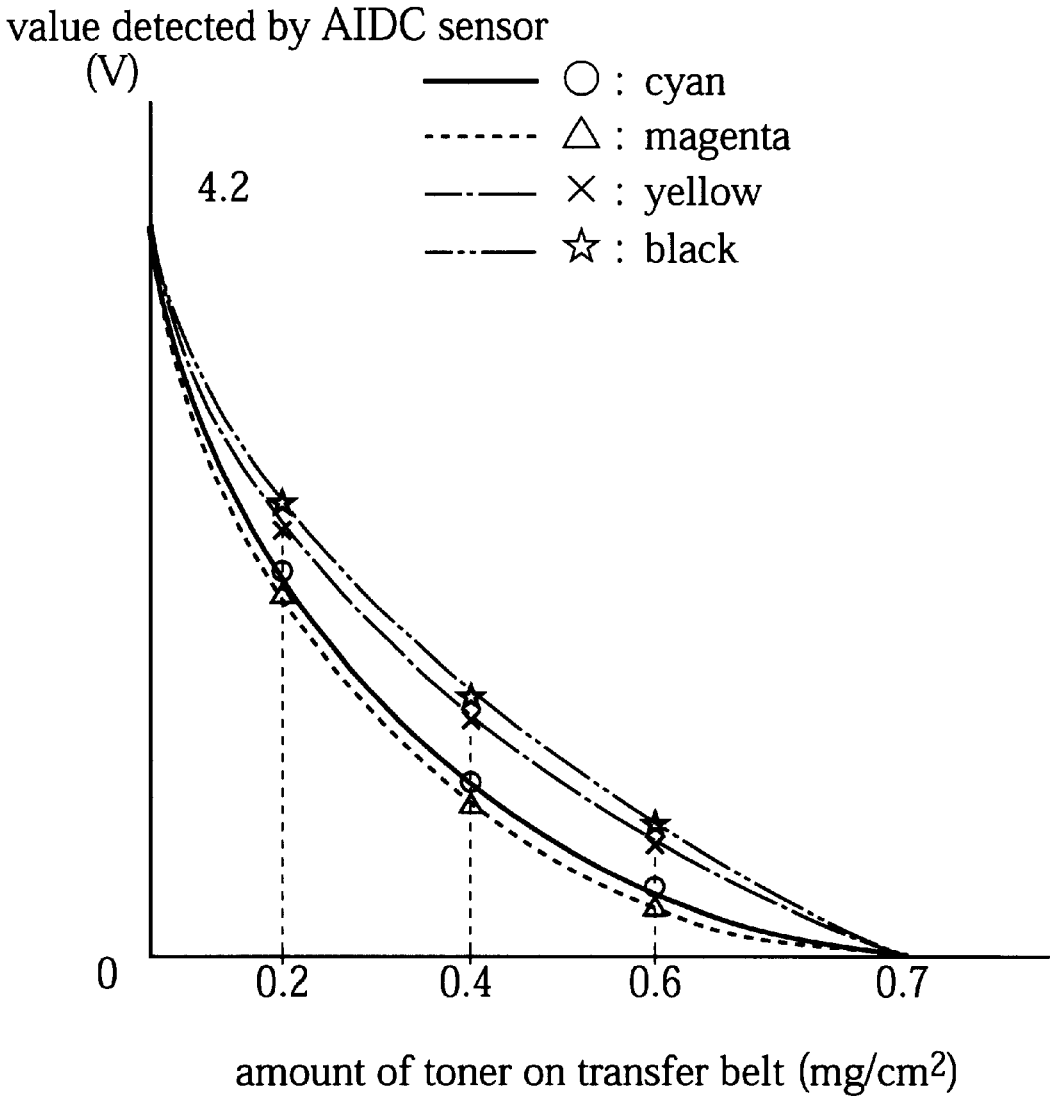
FIG. 10 shows an example of detection results obtained by the AIDC sensors detecting the standard patterns shown in FIG. 9.

Each of the AIDC sensors 22C to 22K detects these three types of standard patterns Pcl, Pcm, and Pcd. FIG. 10 is an example of the detection results. FIG. 10 is a plot of the detection results, with each detection result being obtained from orthogonal coordinates of a sensor detection value V and the amount of toner M(mg/cm$^2$). By means of this figure, a regression function M=F(V) is obtained from the plotted points for each of the curves drawn in a solid line, a dotted line, a dot-dash line, a phantom line according to a method such as a blending method. Then, the respective regression functions are set as transform functions used for obtaining the amounts of toner in the AIDC patterns. Accordingly, the sensitivity adjustment control is terminated.

(2-1-4) Black Standard Pattern Formation

Figure 11:
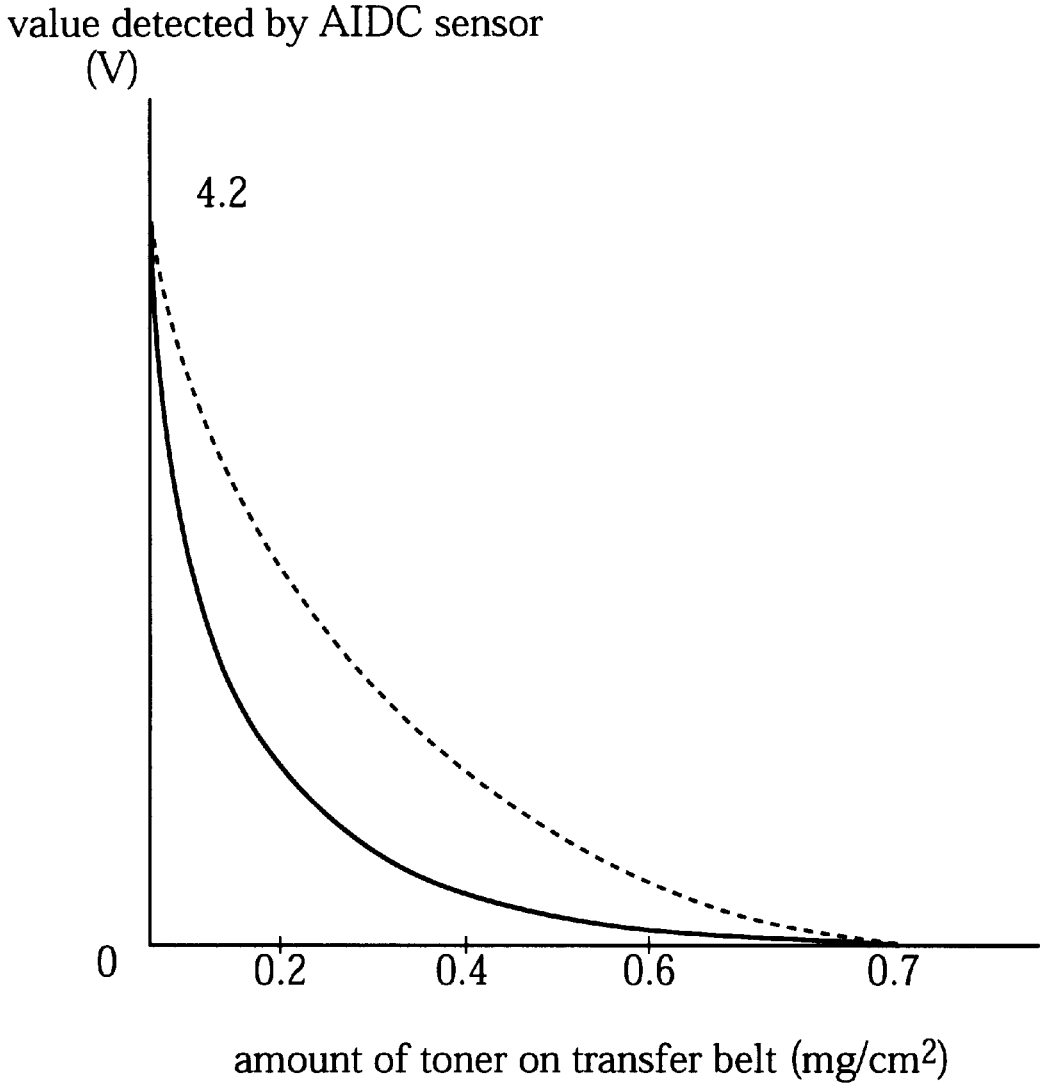
FIG. 11 shows a relation between the amount of black toner containing carbon and a voltage value outputted from the AIDC sensor.

As described above, the mixed toner is used as black toner in the copier. Meanwhile, when the carbon toner is used as black toner, it may be preferable to form the standard patterns using this black toner. The reflectivity of carbon toner is considerably low in the infrared region. A relation between the amount of carbon toner attracted to the transfer belt 10 and the detection value obtained by the AIDC sensor is represented by a solid line in FIG. 11. A dotted line in FIG. 11 represents a relation between the amount of mixed toner and the detection value. As seen from the solid line of FIG. 11, variations in the detected voltage are remarkably small for large amounts of carbon toner. This is to say, in an area where a large amount of carbon toner is attracted to the transfer belt 10, small changes in sensitivity of the AIDC sensor 22C to 22K cause large differences in the amount of toner obtained from the detection value. As such, it is preferable for the sensitivity adjustment control to be executed using the standard patterns formed from the carbon toner which requires great precision in detection. By doing so, variations in sensitivity among the AIDC sensors 22C to 22K detecting the black standard patterns can be appropriately adjusted.

Figure 12:
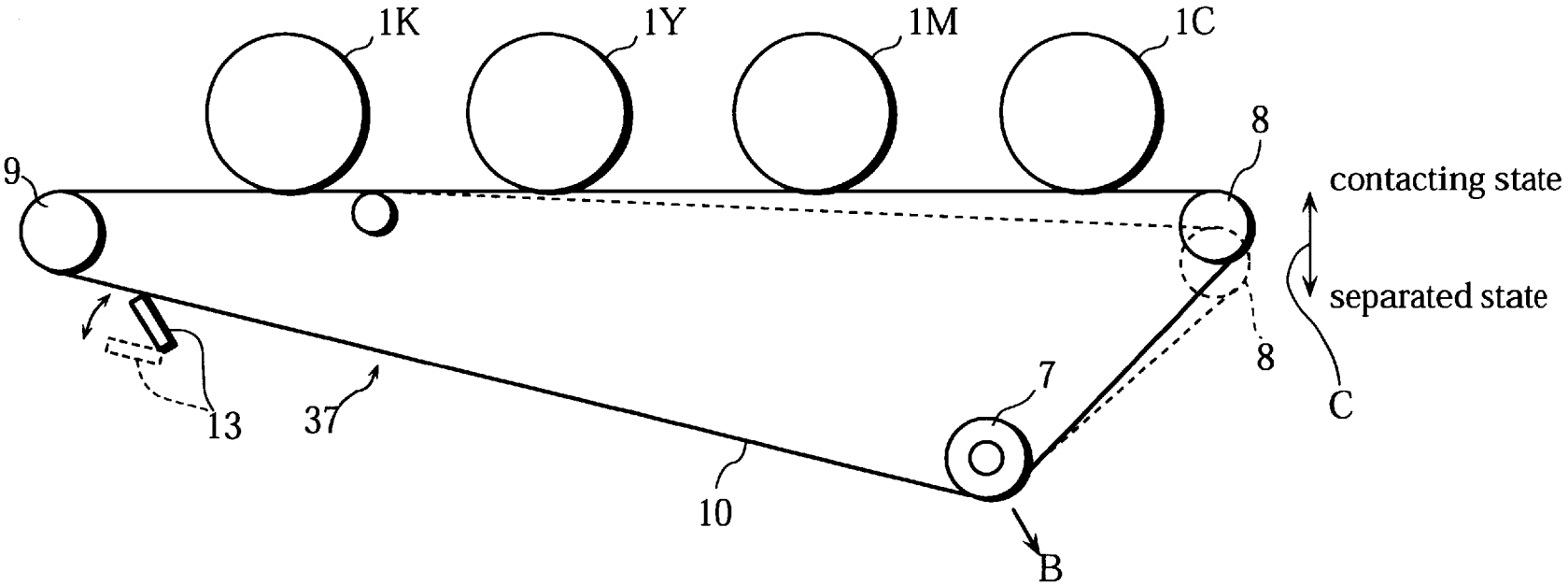
FIG. 12 shows an example of a mechanism for separating a transfer belt from photosensitive drums.

The following is a detailed description of the sensitivity adjustment control using the black standard patterns. In general, a photosensitive drum for black is located at the downstream side of any other photosensitive drum in the transporting direction of the recording sheet. For this reason, the black standard patterns formed on the transfer belt 10 at the downstream side need to be moved halfway around to the upstream side, so that the AIDC sensors 22C to 22Y can detect the respective standard patterns. When doing so, the photosensitive drums 1C to 1Y are unnecessarily rotated, thereby causing needless wear and tear on the surfaces of the three photosensitive drums 1C to 1Y. To avoid this problem, it is desirable for the copier to be provided with a mechanism for separating the surface of the transfer belt 10 from the photosensitive drums 1C to 1Y in a monochrome copy mode, as shown in FIG. 12. Consequently, the image forming units aside from the image forming unit used for forming a black image do not need to be activated.

The transfer belt 10 runs over a tension roller 7, a slave roller 8, and a driving roller 9. The tension roller 7 is energized by a mechanism (not shown) in the direction of the arrow B shown in FIG. 12 so that the tension of the transfer belt 10 is kept constant. The slave roller 8 is shifted in the direction of the arrow C by a driving mechanism (not shown). When image formation is performed in a color copy mode using the photosensitive drums 1C to 1K, the slave roller 8 is shifted upward, so that the photosensitive drums 1C to 1K come in contact with the recording sheet transporting surface of the transport belt 10. This state of the transfer belt 10 is indicated by a solid line in FIG. 12 and referred to as the "contacting state" hereinafter. Meanwhile, when image formation is performed in the monochrome copy mode using only the photosensitive drum 1K, the slave roller 8 is shifted downward, so that the right-hand side of the transfer belt 10 from a supporting roller 11 is separated from the photosensitive drums 1C to 1Y. By means of the supporting roller 11, the photosensitive drum 1K stays in contact with the transfer belt 10. This state of the transfer belt 10 is indicated by a dotted line in FIG. 12 and referred to as the "separated state" hereinafter.

When using the carbon toner that has a different reflectivity to the reflectivity of the C, M, and Y toner, tables used for the sensitivity adjustment control of the AIDC sensor 22K are provided separately from the tables shown in FIGS. 7*a* to 7*e*.

FIGS. 13*a* to 13*e* show the tables corresponding to the sensitivity of the AIDC sensor 22K in a case where the carbon toner is used. As in the case of FIGS. 7*a* to 7*e*, FIGS. 13*a* to 13*e* are shown in descending order of the sensitivity.

The operation performed for selecting one of the tables here is basically the same as the operation performed when selecting one of the tables shown in FIGS. 7*a* to 7*e* using the cyan standard patterns. A difference in the present operation from the stated operation using FIGS. 7*a* to 7*e* is that the amount of toner attracted to the transfer belt 10 is obtained from the detection values given by the AIDC sensors 22C to 22K using the table shown in FIG. 13*c* since the standard patterns are formed from the carbon toner. The obtained amount of toner is set as an evaluation value, and the sensitivity is evaluated using the evaluation value for each of the AIDC sensors 22C to 22K. In accordance with the evaluated sensitivity, the table to be used for the sensitivity adjustment control of the AIDC sensor 22K is selected from FIGS. 13*a* to 13*e*. Here, note that the tables to be used for the sensitivity adjustment control of the AIDC sensors 22C to 22Y are separately selected from FIGS. 7*a* to 7*e*.

It is preferable to control the operation as follows when using the copier having the mechanism for separating the transfer belt 10 from the photosensitive drums 1C to 1Y in the monochrome copy mode as shown in FIG. 12. The black standard patterns are formed on the transfer belt 10, with the transfer belt 10 being in the separated state. The AIDC sensor 22K detects the corresponding standard pattern. Then, the transfer belt 10 moves so that the standard patterns are detected by the corresponding AIDC sensors 22C to 22Y. When the standard patterns reach the upstream side, the state of the transfer belt 10 is switched from the separated state to the contacting state. By doing so, unnecessary rotation of the photosensitive drums 1C to 1Y can be avoided. Note that a cleaning blade 13 shown in FIG. 12 is separated from the surface of the transfer belt 10 when the detection of the standard patterns are executed.

Accordingly, the sensitivity can be reliably adjusted using black standard patterns formed from toner whose reflectivity is considerably low, such as the carbon toner, since the detection of the amount of black toner requires great precision. In other words, for the reliable detection of the amount of toner, it is preferable to form the standard patterns using a toner, out of toners used by the image forming units, whose detection results in lowest values being outputted by the AIDC sensors 22C to 22K.

Second Embodiment

(1) Constructions of Copier and Control System

In the first embodiment, the amount of toner in the standard pattern is set to the standard amount by coordinating the image forming conditions. However, it may be difficult to reliably form the standard pattern of the standard amount of toner by coordinating the image forming conditions. To address this problem, the correct amount of toner in the standard pattern is obtained from a different method in the second embodiment.

The copier used in the second embodiment is the same as the tandem-type digital color copier having the construction shown in FIG. 4 of the first embodiment. Although the image reading unit for reading the document image is not necessarily required in the first embodiment, it is needed in the second embodiment as a general rule. However, when using an image forming apparatus not having an image reading unit, such as a printer, the problem is solved by providing an external device such as a scanner.

The construction of the control system in the second embodiment is basically the same as the construction shown in FIG. 5 of the first embodiment. Yet, the programs used for the sensitivity adjustment control are different between these embodiments. The following is a description of the operation performed in the second embodiment.

(2-1) Sensitivity Adjustment Control

Figure 14:
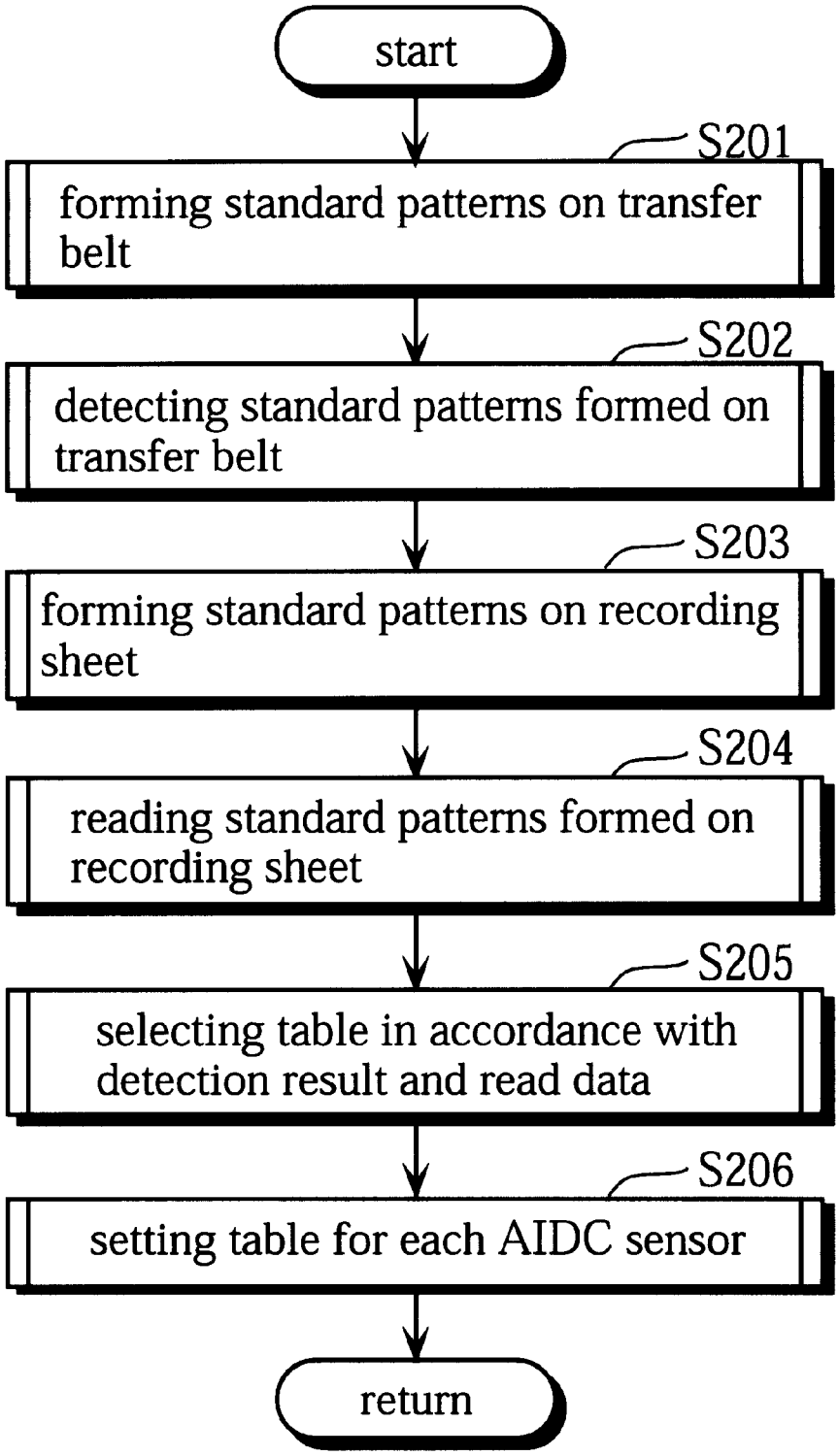
FIG. 14 is a flowchart of an operation performed for the first AIDC sensor sensitivity adjustment control of the second embodiment.

FIG. 14 is a flowchart of the operation performed for the sensitivity adjustment control of the second embodiment. As in the case of the first embodiment, the printing control unit 201 converts the voltage values outputted from the AIDC sensors 22C to 22K into the amount of toner using the tables. Also, for the sensitivity adjustment control, the tables shown in FIGS. 7*a* to 7*e* are selectively used in accordance with the sensitivity of the AIDC sensor.

The printing control unit 201 first controls the image forming unit including the photosensitive drum 1C to form the standard patterns Pcm on the transfer belt 10 as shown in FIG. 8 (step S201). The image forming conditions are tentatively set so that each amount of toner attracted to the transfer belt 10 to form the standard pattern Pcm is 0.4(mg/$cm^2$). The standard patterns Pcm are respectively detected by the AIDC sensors 22C to 22K. Each of the AIDC sensors 22C to 22K outputs the detection values of the standard pattern Pcm as the voltage value to the printing control unit 201 which then stores the voltage value in its internal memory (step S202). The printing control unit 201 next instructs the copying control unit 231 to feed a recording sheet from a paper feeding cassette and to form the standard patterns on the recording sheet under the same condition as in the case of forming the standard patterns on the transfer belt as shown in FIG. 8, and then has the recording sheet discharged (step S203).

Next, the user of the copier sets the discharged recording sheet on the platen glass 27 and gives an instruction so that the image reading unit 100 reads the standard patterns formed on the recording sheet. Here, the user gives the instruction in accordance with the contents displayed on the display panel 230.

The image reading unit 100 scans the standard patterns using the scanner and has the CCD sensor 31 performs the optical conversion to obtain the multivalued electric signals for three colors R, G, and B (step S204). From the electric signals for R which is a complementary color of cyan, a reflectivity D of red light is obtained. Then, based on the reflectivity D, the density of cyan is obtained as−logD. It should be noted here that the sensitivity adjustment control may be performed in consideration of a difference between the reflectivity of the transfer belt 10 and the recording sheet.

Figure 15:
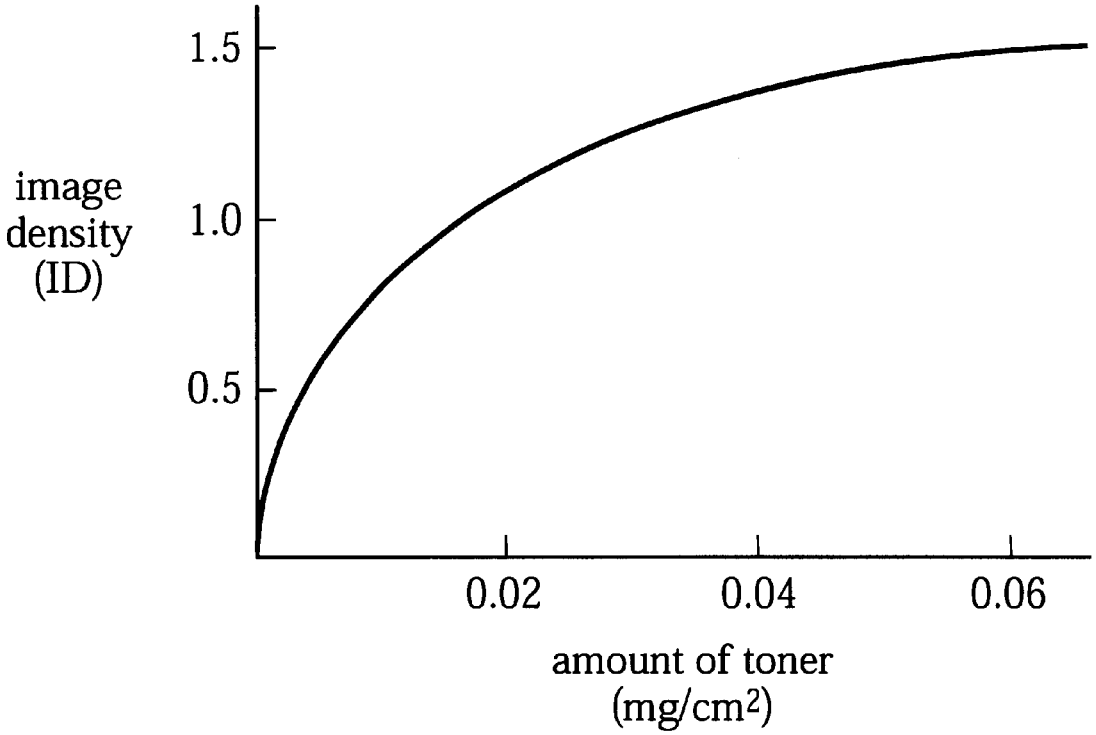
FIG. 15 shows a relation between the density and the amount of toner.

FIG. 15 shows a relation between the detection value and the amount of toner. Based on this relation, the amount of toner in the standard pattern is obtained from its density. Suppose that the value 0.36(mg/$cm^2$) is obtained here. This value is set as a reference value for evaluating the sensitivity of the AIDC sensors 22C to 22K.

Specifically, using the table of FIG. 7*c*, an amount of toner is obtained as the evaluation value from the voltage value that was given by each of the AIDC sensors 22C to 22K and stored in the printing control unit 201 in step S202. In accordance with a difference between this amount of toner and the reference value obtained by the CCD sensor 31, one of the tables shown in FIGS. 7*a* to 7*e* is selected for each of the AIDC sensors 22C to 22K (step S205).

As stated, the amount of toner obtained by the CCD sensor 31 is 0.36(mg/cm$^2$) as one example. When the amount of toner obtained using FIG. 7*c* is equal to or more than 0.41(mg/cm$^2$), the table of FIG. 7*a* corresponding to the AIDC sensor having the highest sensitivity is selected. When the amount of toner is equal to or more than 0.36 (mg/cm$^2$) and less than 0.41(mg/cm$^2$), the table of FIG. 7*b* corresponding to the AIDC sensor having the rather high sensitivity is selected. When the amount of toner is equal to or more than 0.31(mg/cm$^2$) and less than 0.36(mg/cm$^2$), the table of FIG. 7*c* corresponding to the AIDC sensor having the normal sensitivity is selected. When the amount of toner is equal to or more than 0.26(mg/cm$^2$) and less than 0.31 (mg/cm$^2$), the table of FIG. 7*d* corresponding to the AIDC sensor having the rather low sensitivity is selected. When the amount of toner is less than 0.26(mg/cm$^2$), the table of FIG. 7*e* corresponding to the AIDC sensor having the lowest sensitivity is selected. After selecting the table for each of the AIDC sensors, the selected table is set as the table used for obtaining the amount of toner in the AIDC pattern (step S206).

By means of the stated operation, the sensitivity is adjusted for each of the AIDC sensors 22C to 22K, not in reference to the amount of toner that is assumed from the image forming conditions but in reference to the amount of toner that is more precisely detected by the CCD sensor 31 as the reference value. This enables the sensitivity adjustment control to be executed with higher precision.

(2-2) Adjustment by Forming Table

The amount of toner in the standard pattern is obtained with higher precision when using the CCD sensor 31. As such, the tables do not need to be previously formed to be selected, and a table may be formed for each of the AIDC sensors 22C to 22K.

Figure 16:
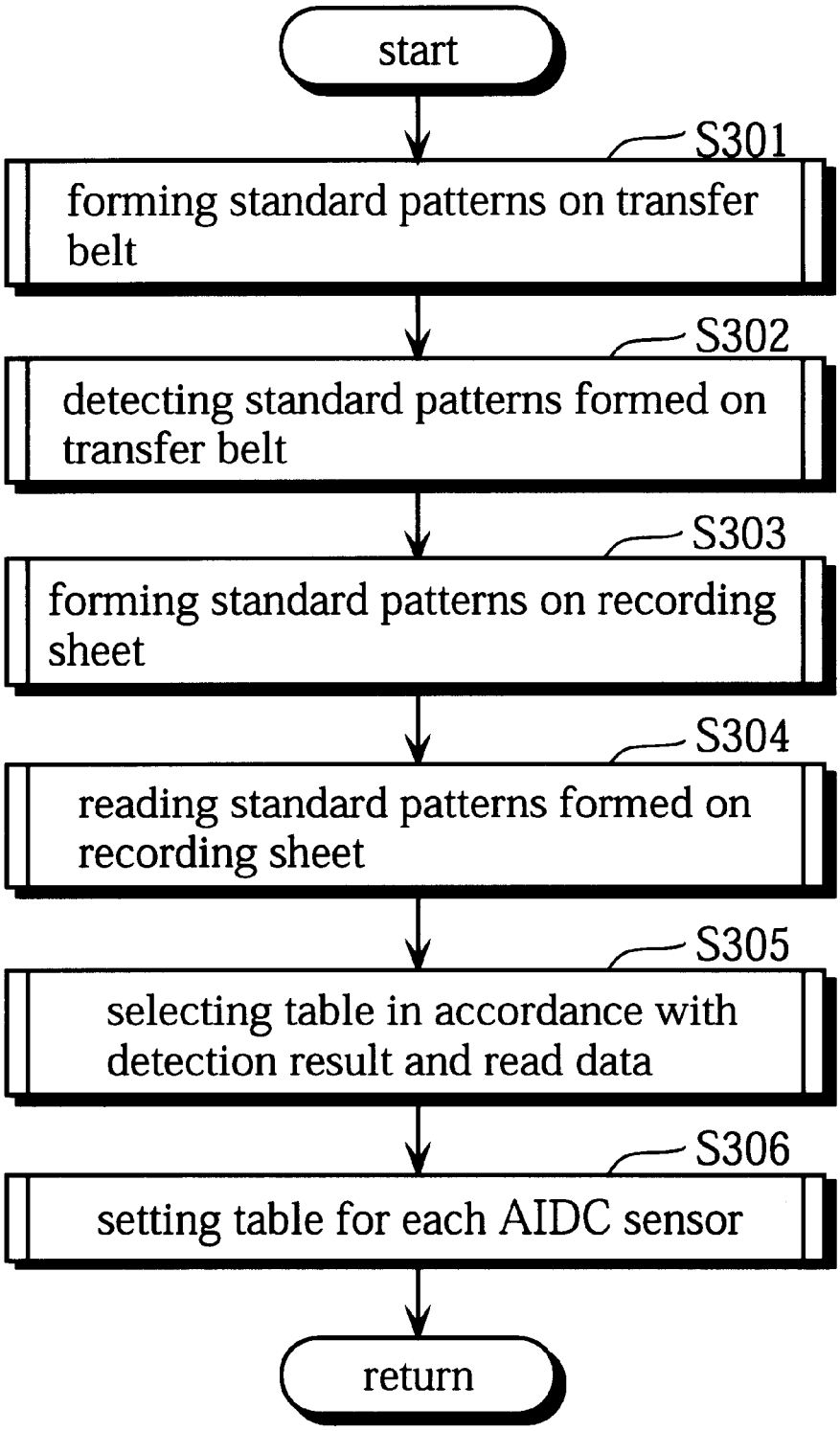
FIG. 16 is a flowchart of an operation performed for the second AIDC sensor sensitivity adjustment control of the second embodiment.
Figure 17:
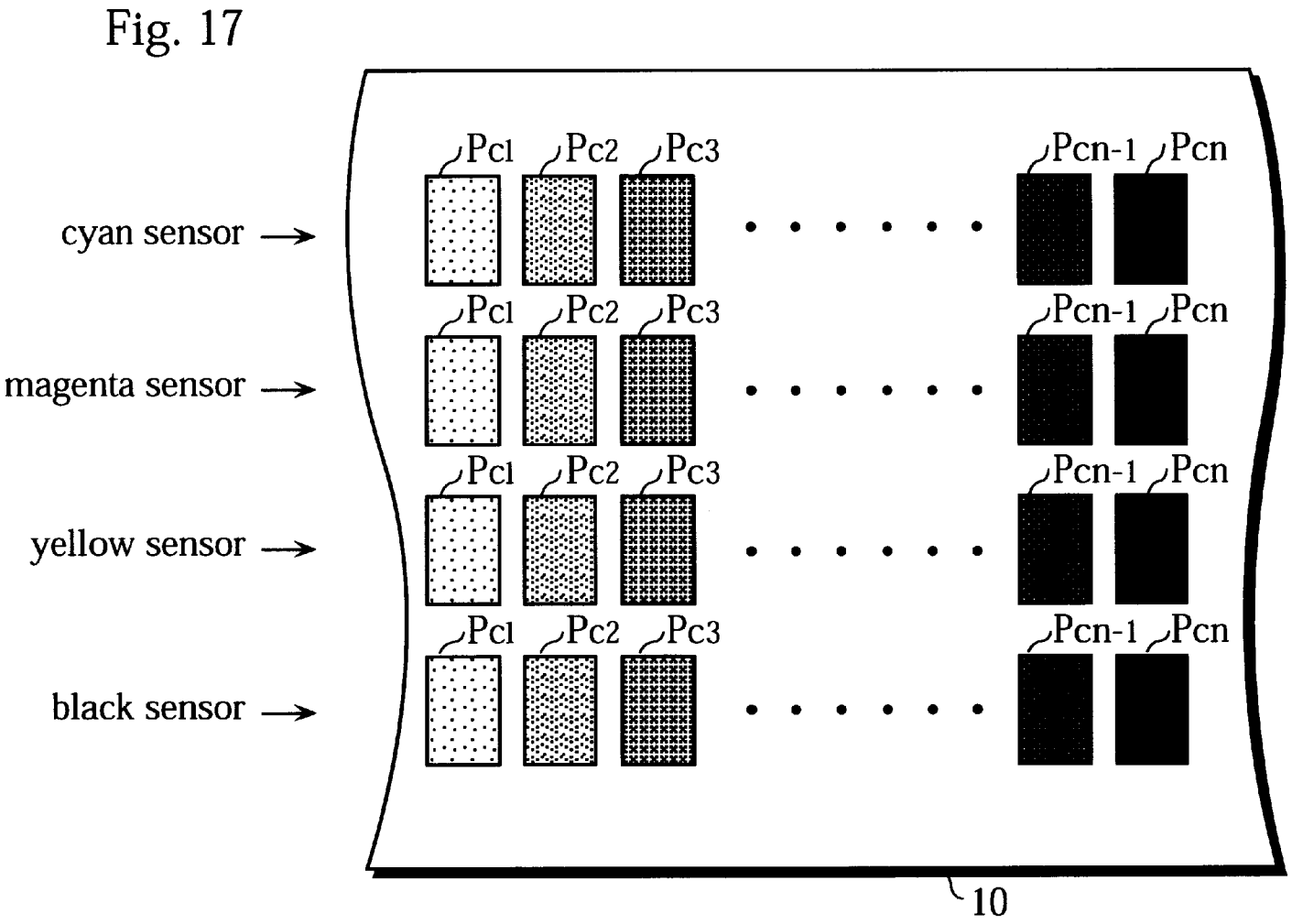
FIG. 17 shows an example of standard patterns used for the second AIDC sensor sensitivity adjustment control of the second embodiment.

The following is a description of an operation for forming the table. FIG. 16 is a flowchart of this operation. The printing control unit 201 first controls the image forming unit including the photosensitive drum 1C to form the standard patterns Pcl to Pcn on the transfer belt 10 for each of the AIDC sensors 22C to 22K, as shown in FIG. 17 (step S301). The image forming conditions are set so that the standard patterns Pcl to Pcn include progressively larger amounts of toner. The respective standard patterns Pcl to Pcn are formed at locations corresponding to the locations of the AIDC sensor 22C to 22K in the main scanning direction.

Each of the AIDC sensors 22C to 22K detects the corresponding standard patterns Pcl to Pcn and outputs the detection values as the voltage values to the printing control unit 201 (step S302). It should be noted here that the detection by each of the AIDC sensors 22C to 22K is performed every time one of the standard patterns Pcl to Pcn is formed. Thus, processes of steps S301 and S302 are performed in parallel. The outputted voltage value is stored in the printing control unit 201 for each of the AIDC sensors 22C to 22K.

The printing control unit 201 next instructs the copying control unit 231 to form the standard patterns Pcl to Pcn shown in FIG. 17 on the recording sheet under the same condition as in the case of forming the standard patterns on the transfer belt 10, and has the recording sheet discharged (step S303). As stated above, the user sets the discharged recording sheet on the platen glass 27 and gives an instruction so that the image reading unit 100 reads the standard patterns Pcl to Pcn formed on the recording sheet (step S304). Then, a density value is obtained for each of the standard patterns Pcl to Pcn according to the above operation. The density value is converted into the amount of toner by referring to the relation shown in FIG. 15.

By means of this operation, the actual amounts of toner in the standard patterns Pcl to Pcn are obtained, and the voltage values of the standard patterns Pcl to Pcn detected by each of the AIDC sensors 22C to 22K are also obtained. In accordance with the actual amount of toner and the corresponding voltage values, a conversion table showing a relation between the amount of toner and the voltage value can be formed for each of the AIDC sensors 22C to 22K. In the present embodiment, the conversion table shows the relation regarding one of the standard patterns Pcl to Pcn formed of the same amount of toner. This table is set as the conversion table for each of the AIDC sensors 22C to 22K for obtaining the amount of toner in the AIDC pattern (step S306).

Accordingly, the tables do not need to be previously formed. Using the detection value given by the corresponding AIDC sensor 22C to 22K, the table is formed for each of the AIDC sensors 22C to 22K. By doing so, an adverse effect of a delicate error caused during manufacturing of the AIDC sensor 22C to 22K can be reduced. Consequently, using this table, the amount of toner is detected with high precision.

As in the case of the first embodiment, using one table as the standard table, the amount of toner may be adjusted by a correction coefficient calculated from the correct amount of toner obtained by the CCD image sensor 31 and the voltage value detected by the AIDC sensor 22C to 22K. Also, the standard patterns formed of respective different amounts of toner may be detected, so that a regression function may be obtained from the correct amount of toner and the detected voltage value. Then, this regression function may be set as a transform function used for transforming the detected voltage value into the amount of toner.

In the present embodiment, after the AIDC sensors 22C to 22K detect the standard patterns formed on the transfer belt 10, the standard patterns are formed on the recording sheet. However, the AIDC sensors 22C to 22K may detect the standard patterns formed on the recording sheet. The recording sheet is discharged after the detection by the AIDC sensors 22C to 22K, and is set on the platen glass 27 by the user so that the image reading unit 100 detects the standard patterns formed on the recording sheet. In this case, a process may be performed for considering the reflectivity of the recording sheet and the transfer belt 10.

In the first and second embodiments, each detection value given by the AIDC sensors 22C to 22K is converted into the amount of toner before being converted into the grid voltage VG and the developing bias voltage VB. The sensitivity of the AIDC sensor 22C to 22K is adjusted in the process for converting the detection value to the amount of toner. However, a timing of the adjustment is not limited to this. The voltage values outputted from the AIDC sensors 22C to 22K may be adjusted using a conversion table, or may be adjusted through multiplication and addition using a correction coefficient. Alternatively, the values outputted from the AIDC sensors 22C to 22K may be directly converted into the grid voltage VG and the developing bias voltage VB, so that the sensitivity is adjusted in this conversion. This is to say, the sensitivity of the AIDC sensors 22C to 22K can be adjusted if the adjustment is made to one variable generated between when the AIDC sensors 22C to 22K outputs the values and when the image forming conditions including the grid voltage VG and the developing bias voltage VB are set.

In the stated embodiments, the sensitivity of the AIDC sensors 22C to 22K are adjusted by having the AIDC sensors 22C to 22K detect the standard patterns formed by one photosensitive drum. However, the standard patterns may be previously formed at locations corresponding to the AIDC sensors 22C to 22K on the transfer belt 10. In this case, the standard patterns having a density corresponding to a predetermined amount of toner are formed on the transfer belt 10 in a way that the formed standard patterns are not easily removed by a cleaning component such as a cleaning blade. The sensitivity of the AIDC sensors 22C to 22K may be adjusted by having the AIDC sensors 22C to 22K detect these standard patterns. Alternatively, the standard patterns having the density corresponding to the predetermined amount of toner may be previously printed on a recording sheet. In this case, the recording sheet may be transported by a paper supplying component and the AIDC sensors 22C to 22K detect the standard patterns formed on the recording sheet for the adjustment of their sensitivity. It is only essential for the AIDC sensors 22C to 22K to detect standard patterns formed under the same condition for the sensitivity adjustment of the AIDC sensors 22C to 22K.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An image forming apparatus, comprising:

a plurality of image forming units, each of which has an image holder and forms an image on the image holder according to set image forming conditions;

a transfer unit for transferring images formed by each image forming unit onto a transfer medium;

a plurality of sensors, each of which is located near a different image forming unit and detects a density of an image transferred from a proximate image forming unit to the transfer medium;

an adjustment unit for adjusting the image forming conditions of each image forming unit according to a detection value produced by each sensor;

a control unit for having the transfer unit transfer, onto the transfer medium, a standard image formed by an image forming unit located furtheset upstream in a direction in which the transfer medium moves; and a correction unit for correcting, based on the detection values produced when the sensors read the standard image produced under control of the control unit, the detection values of the sensors before the detection values are used by the adjustment unit.

2. An image forming apparatus according to claim 1, wherein the transfer medium is a belt loop.

3. An image forming apparatus according to claim 1, wherein the transfer medium is a sheet of paper.

4. An image forming apparatus according to claim 1, wherein the transfer unit includes a belt loop and the plurality of image forming units are provided along the belt loop.

5. An image forming apparatus according to claim 1, wherein each image forming unit forms a toner image on the image holder in the image forming unit.

6. A method for adjusting image forming conditions in an image forming apparatus, the image forming apparatus including a plurality of image forming units that are provided along a transfer medium, a plurality of sensors that each correspond to a different image forming unit and detect a density of an image that has been formed by a corresponding image forming unit and transferred onto the transfer medium, an adjustment unit for adjusting the image forming conditions of each image forming unit according to detection values produced by the sensors, the image forming method comprising steps of:

having an image forming unit positioned furthest upstream with respect to a movement direction of the transfer medium form a standard image and transfer the standard image onto to transfer medium;

having each sensor read the standard image on the transfer medium; and correcting, according to detection values produced when the sensors read the standard image, the detection values produced by the sensors that are used by the adjustment unit to adjust the image forming conditions.

7. A method for adjusting image forming conditions in an image forming apparatus, the image forming apparatus including a plurality of image forming units that arc provided along a transfer medium, a plurality of sensors that each correspond to a different image forming unit and detect a density of an image that has been formed by a corresponding image forming unit and transferred onto the transfer medium, an adjustment unit for adjusting the image forming conditions of each image forming unit according to detection values produced by the sensors, the image forming method comprising steps of:

having a standard image formed by an image forming unit, out of the plurality of images forming units, positioned furthest upstream in a movement direction of the transfer medium;

transferring the formed standard image onto the transfer medium;

having the transferred standard image read by each sensor to produce a detection value for each sensor;

correcting values outputted by each sensor based on the detection value produced by the sensor; and setting the image forming conditions of each image forming unit based on the corrected values outputted by the sensor corresponding to the image forming unit.

8. An image forming apparatus, comprising:

a plurality of image forming units, each of which has an image holder and forms an image on the image holder according to set image forming conditions;

a transfer unit for transferring images formed by each image forming unit onto a transfer medium or a recording medium carried by the transfer medium;

a control unit for having the transfer unit transfer a standard image formed by each image forming unit onto the transfer medium so that the standard images do not overlap each other, and then transfer each of the standard images onto the recording medium so that the standard images do not overlap each other;

a plurality of sensors, each of which is located near a different image forming unit and detects a density of the standard image transferred from a proximate image forming unit onto the transfer medium;

an adjustment unit for adjusting the image forming conditions of each image forming unit according to a detection value produced by each sensor;

an image reading unit for reading the standard images formed on the recording medium and detecting density of each of the standard images; and a sensitivity adjustment unit for adjusting sensitivity of each of the plurality of sensors based on a difference between the density of each of the standard images formed on the recording medium and detected by the image reading unit, and the density of each of the standard images formed on the transfer medium and detected by each of the plurality of sensors.

9. An image forming apparatus according to claim 8, wherein each image forming unit forms a toner image on the image holder in the image forming unit.

10. A method for adjusting image forming conditions in an image forming apparatus, the image forming apparatus including a plurality of image forming units that are provided along a transfer medium, a plurality of sensors that each corresponds to a different image forming unit and detects a density of an image that has been formed by a corresponding image forming unit and transferred onto the transfer medium, an adjustment unit for adjusting the image forming conditions of each image forming unit according to detection values produced by the sensors, and an image reading unit for reading images formed by each image forming unit and transferred onto a recording medium carried on the transfer medium and detecting density of each of the images, the image forming method comprising steps of:

having each image forming unit form a standard image and transfer the standard image onto to transfer medium, the standard images on the transfer medium not overlapping each other;

having each sensor read the standard image on the transfer medium;

having each image forming unit form the standard images and transfer the standard images onto to the recording medium carried on the transfer medium, the standard images on the recording medium not overlapping each other;

having the image reading unit read the standard images formed on the recording medium and detect density of each of the standard images; and adjust the sensitivity of each sensor based on a difference between the density of each of the standard images formed on the recording medium and detected by the image reading unit, and the density of each of the standard images formed on the transfer medium and detected by each sensor.

* * * * *